US010707582B2

(12) United States Patent
Fabrega Sanchez et al.

(10) Patent No.: US 10,707,582 B2
(45) Date of Patent: Jul. 7, 2020

(54) WIDE-BAND DIPOLE ANTENNA

(71) Applicant: QUALCOMM Incorporated, San Diego, CA (US)

(72) Inventors: Jorge Fabrega Sanchez, San Diego, CA (US); Mohammad Ali Tassoudji, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 42 days.

(21) Appl. No.: 16/146,742

(22) Filed: Sep. 28, 2018

(65) Prior Publication Data

US 2020/0106184 A1 Apr. 2, 2020

(51) Int. Cl.

| | |
|---|---|
| ***H01Q 1/38*** | (2006.01) |
| ***H01Q 9/26*** | (2006.01) |
| ***H01Q 5/364*** | (2015.01) |
| ***H01Q 1/24*** | (2006.01) |
| ***H01Q 21/06*** | (2006.01) |

(52) U.S. Cl.

CPC ..... *H01Q 9/26* (2013.01); *H01Q 1/243* (2013.01); *H01Q 1/38* (2013.01); *H01Q 5/364* (2015.01); *H01Q 21/062* (2013.01)

(58) Field of Classification Search

CPC ..... H01Q 9/26; H01Q 9/42; H01Q 5/364; H01Q 1/243; H01Q 1/38; H01Q 21/062

See application file for complete search history.

(56) References Cited

U.S. PATENT DOCUMENTS

| | | | | |
|---|---|---|---|---|
| 8,013,800 | B2 | 9/2011 | Zheng et al. | |
| 9,698,485 | B2 | 7/2017 | Gaier et al. | |
| 9,847,581 | B2 | 12/2017 | De et al. | |
| 10,084,241 | B1 | 9/2018 | Jenwatanavet et al. | |
| 2005/0017906 | A1 | 1/2005 | Man et al. | |
| 2009/0051614 | A1* | 2/2009 | Wong | H01Q 1/243 343/803 |

(Continued)

FOREIGN PATENT DOCUMENTS

GB 2429845 A 3/2007

OTHER PUBLICATIONS

Hwang I-J., et al., "Vertically Stacked Folded Dipole Antenna using Multi-Layer for mm-Wave Mobile Terminals", IEEE, 2017, pp. 2579-2580.

(Continued)

*Primary Examiner* — Graham P Smith

(74) *Attorney, Agent, or Firm* — Qualcomm Incorporated

(57) ABSTRACT

A millimeter-wave antenna system includes: a ground plane; and a folded dipole radiator including: a plurality of feeds each extending away from the ground plane from a proximal feed end to a distal end; a plurality of radiating arms each coupled to and extending away from the distal feed end of a respective one of the plurality of feeds; and a plurality of folded conductors each coupled to a respective one of the plurality of radiating arms and each having a distal portion extending toward the ground plane to a distal conductor end; where each of the plurality of feeds and each of the plurality of radiating arms comprises an electrical conductor; and where the folded dipole radiator is discontinuous, without a conductive connection between the plurality of feeds via the plurality of radiating arms.

26 Claims, 7 Drawing Sheets

(56) References Cited

U.S. PATENT DOCUMENTS

| | | | |
|---|---|---|---|
| 2016/0181868 | A1 | 6/2016 | Casse et al. |
| 2016/0248169 | A1 | 8/2016 | Mohammadian et al. |

OTHER PUBLICATIONS

Montero-De-Paz J., et al., "Millimeter-Wave Receiver Based on a Folded Dipole Antenna and Schottky Diode for Maximum Power Transfer", 6th European Conference on Antennas and Propagation (EUCAP), 2011, IEEE, pp. 1259-1262.
International Search Report and Written Opinion—PCT/US2019/050969—ISA/EPO—dated Dec. 10, 2019.

* cited by examiner

WIDE-BAND DIPOLE ANTENNA

BACKGROUND

Wireless communication devices are increasingly popular and increasingly complex. For example, mobile telecommunication devices have progressed from simple phones, to smart phones with multiple communication capabilities (e.g., multiple cellular communication protocols, Wi-Fi, BLUETOOTH® and other short-range communication protocols), supercomputing processors, cameras, etc. Wireless communication devices have antennas to support communication over a range of frequencies.

As wireless communication technology evolves, mobile communication devices may be configured to communicate using multiple millimeter-wave, e.g., above 25 GHz, beams. Millimeter-wave receive (Rx) beams may align with a transmit (Tx) beam of a 5G base station, that may be referred to as a gNodeB, or gNB, or a WLAN access point, or other source of communication signals. The receive beams may be from a Pseudo-Omni (PO) codebook (i.e., the range and granularity of steering angles), with a relatively large beamwidth, or may be from a narrow codebook, with a relatively small beamwidth. To form beams of varying beamwidths (e.g., narrower beamwidth for data transmission), different antenna array elements types and arrangements may be used. By changing antenna array element weights (signal amplitudes and/or input feed signal phases), beams can be steered to various different scan angles and/or switched between a PO beam and a narrower beam.

SUMMARY

An example of a millimeter-wave antenna system includes: a ground plane; and a folded dipole radiator including: a plurality of feeds each extending away from the ground plane from a proximal feed end to a distal end; a plurality of radiating arms each coupled to and extending away from the distal feed end of a respective one of the plurality of feeds; and a plurality of folded conductors each coupled to a respective one of the plurality of radiating arms and each having a distal portion extending toward the ground plane to a distal conductor end; where each of the plurality of feeds and each of the plurality of radiating arms comprises an electrical conductor; and where the folded dipole radiator is discontinuous, without a conductive connection between the plurality of feeds via the plurality of radiating arms.

Implementations of such a system may include one or more of the following features. The distal portions of the plurality of folded conductors are disposed without another conductive portion of the folded dipole radiator between the distal portions of the plurality of folded conductors. The distal portions of the plurality of folded conductors are separated from each other by less than 0.1 wavelengths at a frequency at which the folded dipole radiator has an insertion loss of better than −10 dB. The distal conductor end of each of the plurality of folded conductors is disposed between the plurality of feeds. The plurality of feeds are parallel to each other and to a centerline of the folded dipole radiator, and wherein each of the plurality of folded conductors extends further away from the centerline than the respective one of the plurality of radiating arms to which the folded conductor is coupled. The folded dipole radiator is disposed in a multi-layer structure and configured to have a return loss better than −10 dB from 26.5 GHz to 29.5 GHz and from 37 GHz to 40 GHz. At least a portion of each of the plurality of radiating arms extends away from the distal feed end of the respective one of the plurality of feeds in an opposite direction from another of the plurality of radiating arms. Each of the plurality of radiating arms comprises a first portion extending away from the distal feed end of the respective one of the plurality of feeds in the opposite direction, and wherein each of the plurality of radiating arms comprises a second portion extending away from the first portion in a direction approximately parallel to a direction of the plurality of feeds.

Another example of a millimeter-wave antenna system includes: a ground plane; and a folded dipole radiator including: a plurality of feeds each extending away from the ground plane from a proximal end to a distal feed end; a plurality of radiating arms each coupled to and extending away from the distal feed end of a respective one of the plurality of feeds; and a plurality of folded conductors each coupled to a respective one of the plurality of radiating arms and each extending partially between the plurality of feeds; where each of the plurality of feeds and each of the plurality of radiating arms comprises an electrical conductor.

Implementations of such a system may include one or more of the following features. Each of the plurality of folded conductors has a distal conductor end disposed between the plurality of feeds. The folded dipole radiator is discontinuous, without a conductive connection between the plurality of feeds via the plurality of radiating arms. Distal portions of the plurality of folded conductors are parallel to each other and are disposed without another conductive portion of the folded dipole radiator between the distal portions of the plurality of folded conductors. The distal portions of the plurality of folded conductors are separated from each other by less than 0.1 wavelengths at a frequency at which the folded dipole radiator has an insertion loss of better than −10 dB. The plurality of feeds are parallel to each other and to a centerline of the folded dipole radiator, and wherein each of the plurality of folded conductors extends further away from the centerline than the respective one of the plurality of radiating arms to which the folded conductor is coupled.

An example of an antenna includes: a symmetric radiating structure comprising a first half and a second half each electrically conductive and that are electrically separated from each other, each of the first half and the second half being configured similarly, the first half including: first feed means for connecting to a signal source and for conducting energy from a feed connection to a radiation connection, the first feed means extending in a first direction from the feed connection; radiating means, coupled to the first feed means, for radiating the energy, the radiating means extending from the radiation connection in a second direction away from the second half; and first coupling means, coupled to the radiating means, for coupling energy to second coupling means of the second half.

Implementations of such an antenna may include one or more of the following features. The signal source is configured to provide respective differential signals to the first feed means and to second feed means of the second half. The first coupling means are for capacitively coupling the energy to the second coupling means. A portion of the first coupling means is disposed between the first feed means and second feed means of the second half. The first coupling means and the second coupling means are physically separate, without a direct conductive connection between the first coupling means and the second coupling means. A distal portion of the first coupling means is disposed closer to a centerline of the antenna than the first feed means. The first coupling means extends at least partially between the first feed means and second feed means of the second half. A distal end of the first coupling means is disposed between the first feed means and the second feed means.

Also or alternatively, implementations of such a system may include one or more of the following features. A first distal portion of the first coupling means and a second distal portion of second coupling means of the second half extend parallel to each other and are separated by less than 400 micro-meters. The first feed means, the radiating means, and the first coupling means all include electrically-conductive strips at least partially disposed in a plane. The first coupling means extend further than the radiating means from a centerline of the antenna separating the first half and the second half. The second direction is transverse to the first direction. The first direction is parallel to a centerline of the antenna that divides the first half and the second half.

DETAILED DESCRIPTION

Techniques are discussed herein for providing antennas with broad bandwidths in the presence of a nearby ground. For 5G applications, broad bandwidth radiators are desirable, e.g., radiators that can cover multiple 5G frequency bands such as the 28 GHz band (26.5-29.5 GHz) and the 39 GHz band (37-40 GHz). Similarly, for WLAN, broad bandwidth radiators may be desired for use over multiple bands of the WLAN frequency bands (i.e., WLAN bands of 900 MHz, 2.4 GHz, 3.6 GHz, 4.9 GHz, 5 GHz, 5.9 GHz, and 60 GHz). Folded dipoles may radiate over large bandwidths, and may be placed at a variety of locations and orientations, e.g., at edges of an antenna module where there is ground clearance. Contrary to typical folded dipoles, examples of folded dipoles discussed herein do not form complete loops but rather have at least two separate parts, without an electrical conductor connecting them (e.g., with at least one physical gap of an electrical conductor). Examples of folded dipoles discussed herein have coupled arms disposed near each other, but not electrically connected to each other. The coupled arms may extend parallel to each other, toward a ground plane near feed points of the folded dipole, and may extend between feed arms of the folded dipole. These techniques are examples only, and not exhaustive.

Items and/or techniques described herein may provide one or more of the following capabilities, as well as other capabilities not mentioned. Bandwidth of a dipole in proximity to a ground may be improved. Radiation over multiple 5G and/or WLAN bands may be provided with good return loss. Dipole width may be reduced. Coupling between neighbor dipoles in an array may be reduced. Other capabilities may be provided and not every implementation according to the disclosure must provide any, let alone all, of the capabilities discussed.

Figure 1:
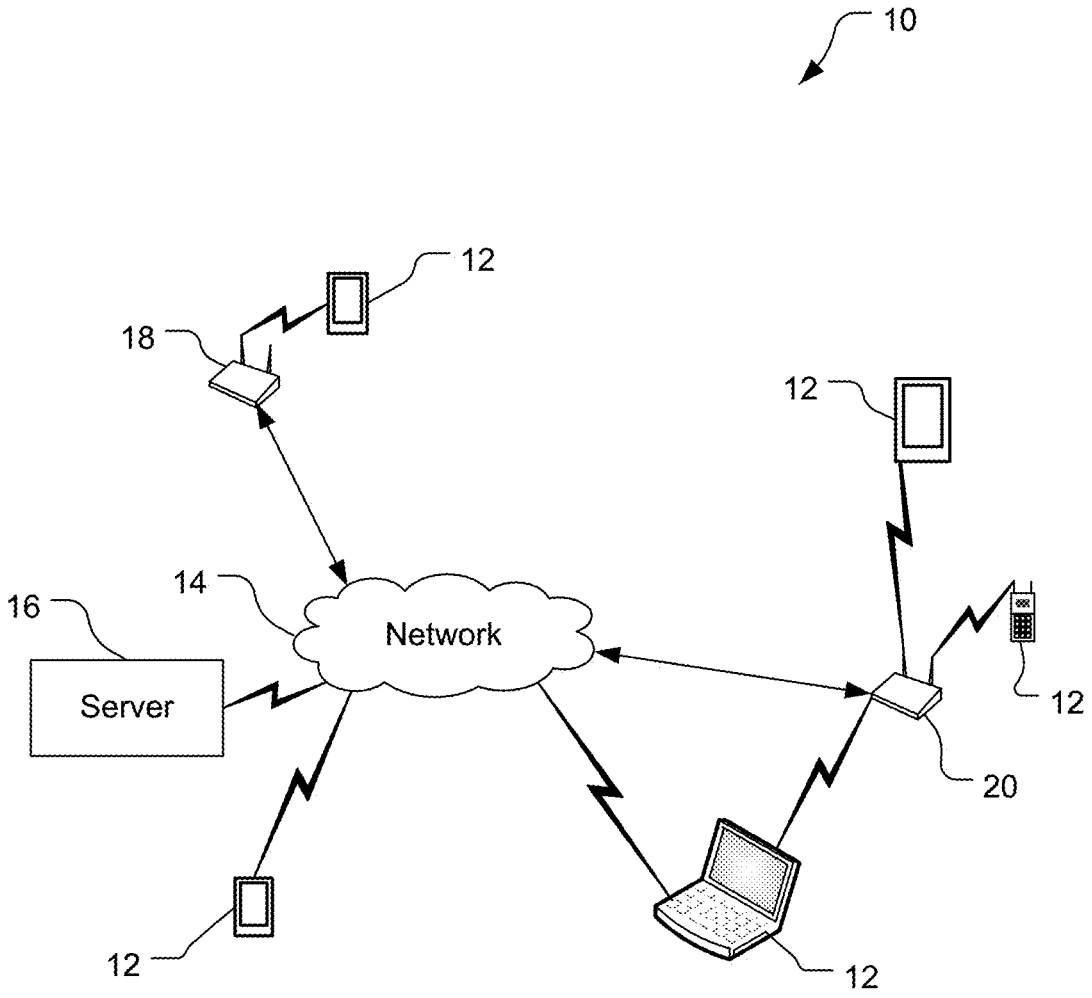
FIG. 1 is a schematic diagram of a communication system.

Referring to FIG. 1, a communication system 10 includes mobile devices 12, a network 14, a server 16, and access points (APs) 18, 20. The system 10 is a wireless communication system in that components of the system 10 can communicate with one another (at least some times using wireless connections) directly or indirectly, e.g., via the network 14 and/or one or more of the access points 18, 20 (and/or one or more other devices not shown, such as one or more base transceiver stations). For indirect communications, the communications may be altered during transmission from one entity to another, e.g., to alter header information of data packets, to change format, etc. The mobile devices 12 shown are mobile wireless communication devices (although they may communicate wirelessly and via wired connections) including mobile phones (including smartphones), a laptop computer, and a tablet computer. Still other mobile devices may be used, whether currently existing or developed in the future. Further, other wireless devices (whether mobile or not) may be implemented within the system 10 and may communicate with each other and/or with the mobile devices 12, network 14, server 16, and/or APs 18, 20. For example, such other devices may include internet of thing (IoT) devices, medical devices, home entertainment and/or automation devices, etc. The mobile devices 12 or other devices may be configured to communicate in different networks and/or for different purposes (e.g., 5G, Wi-Fi communication, multiple frequencies of Wi-Fi communication, satellite positioning, one or more types of cellular communications (e.g., GSM (Global System for Mobiles), CDMA (Code Division Multiple Access), LTE (Long-Term Evolution), etc.). The mobile device 12 is commonly referred to as a user equipment (UE) in UMTS (Universal Mobile Telecommunications System) applications, but may also be referred to as a mobile station (MS), a subscriber station, a mobile unit, a subscriber unit, a wireless unit, a remote unit, a mobile device, a wireless device, a wireless communications device, a remote device, a mobile subscriber station, an access terminal (AT), a mobile terminal, a wireless terminal, a remote terminal, a handset, a terminal, a user agent, a mobile client, a client, or some other suitable terminology.

Figure 2:
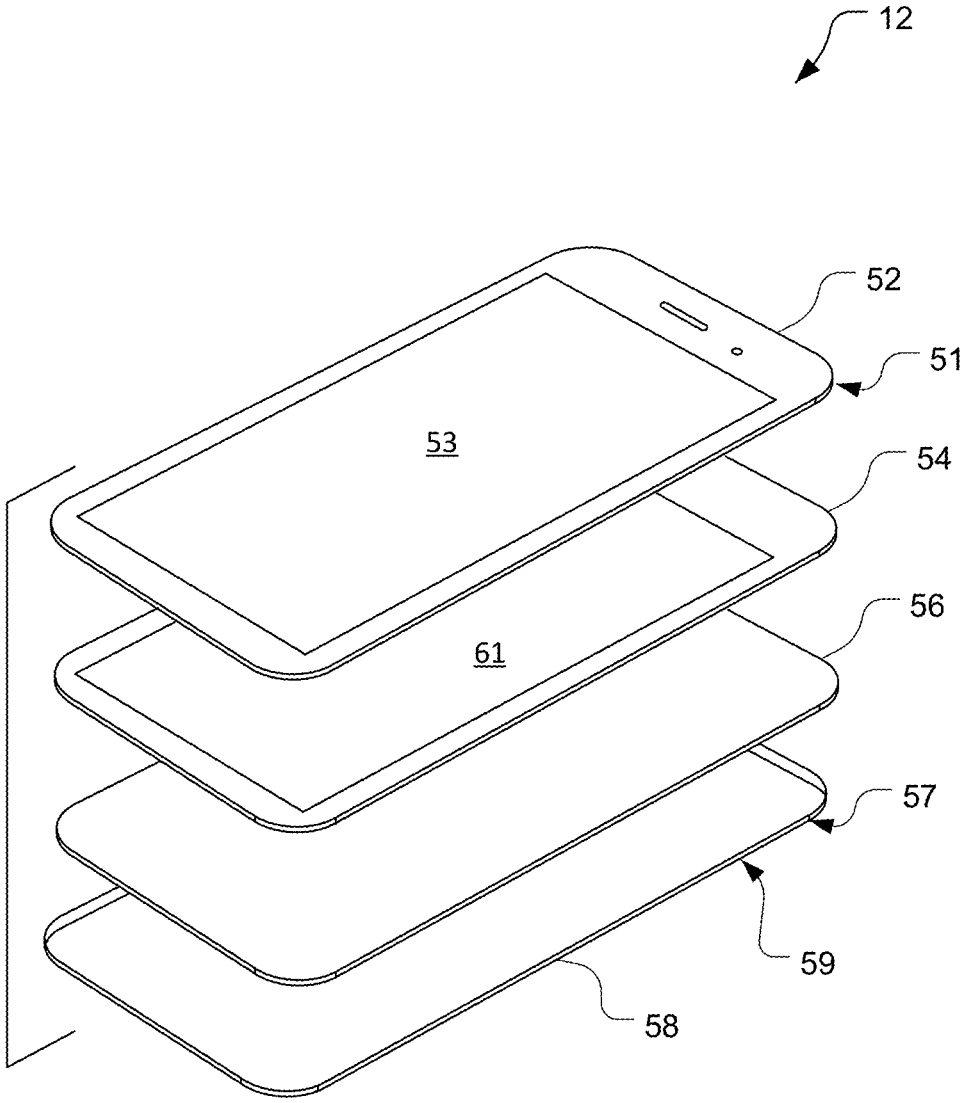
FIG. 2 is an exploded perspective view of simplified components of a mobile device shown in FIG. 1.

Referring to FIG. 2, an example of one of the mobile devices 12 shown in FIG. 1 includes a top cover 52, a display layer 54, a printed circuit board (PCB) layer 56, and a bottom cover 58. The mobile device 12 as shown may be a smartphone or a tablet computer but the discussion is not limited to such devices. The top cover 52 includes a screen 53. The PCB layer 56 includes one or more antennas configured to facilitate bi-directional communication between mobile device 12 and one or more other devices, including other wireless communication devices. The bottom cover 58 has a bottom surface 59 and sides 51, 57 of the top cover 52 and the bottom cover 58 provide an edge surface. The top cover 52 and the bottom cover 58 may comprise a housing that retains the display layer 54, the PCB layer 56, and other components of the mobile device 12 that may or may not be on the PCB layer 56. For example, the housing may retain (e.g., hold, contain) antenna systems, front-end circuits, an intermediate-frequency circuit, and a processor discussed below. Further, the size and/or shape of the PCB layer 56 may not be commensurate with the size and/or shape of either of the top or bottom covers or otherwise with a perimeter of the device. For example, the PCB layer 56 may have a cutout to accept a battery. Those of skill in the art will therefore understand that embodiments of the PCB layer 56 other than those illustrated may be implemented.

Figure 3:
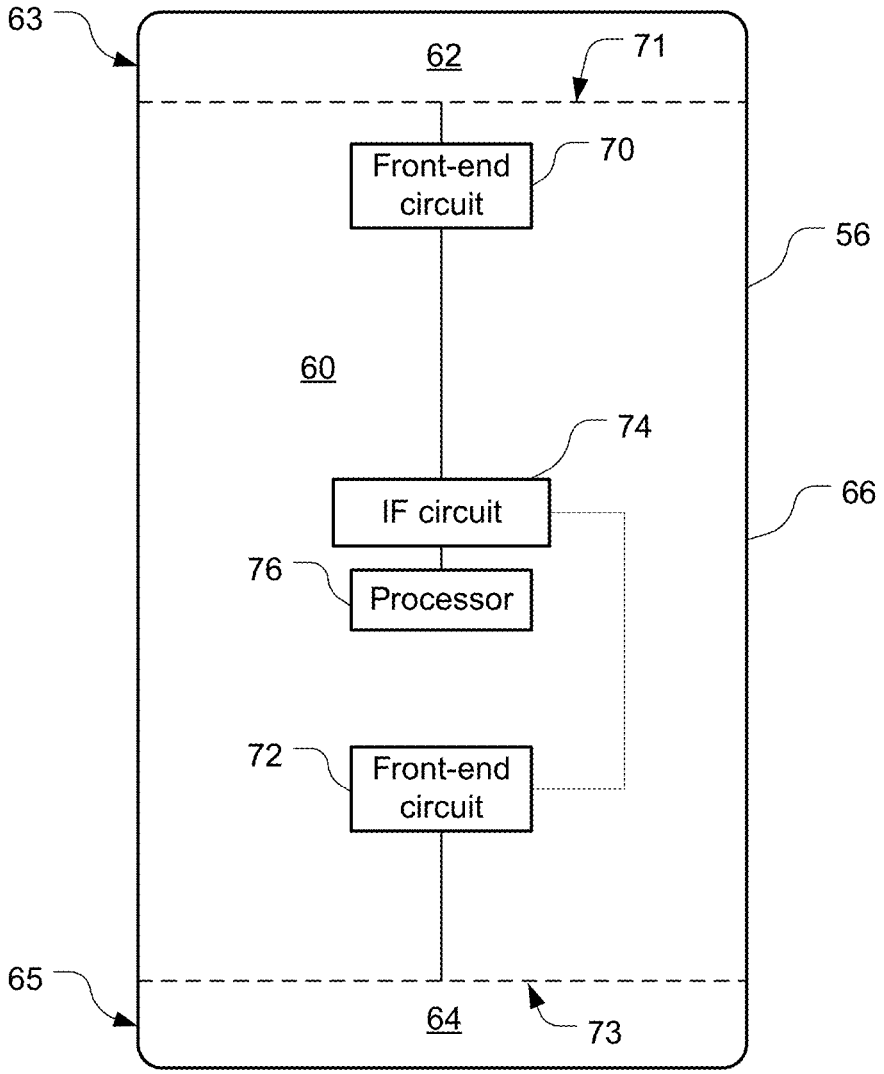
FIG. 3 is a top view of a printed circuit board layer, shown in FIG. 2, including antenna systems.

Referring also to FIG. 3, an example of the PCB layer 56 includes a main portion 60 and two antenna systems 62, 64. In the example shown, the antenna systems 62, 64 are disposed at opposite ends 63, 65 of the PCB layer 56, and thus, in this example, of the mobile device 12 (e.g., of the housing of the mobile device 12). The main portion 60 may comprise a PCB 66 that includes front-end circuits 70, 72 (also called a radio frequency (RF) circuit), an intermediate-frequency (IF) circuit 74, and a processor 76. The front-end circuits 70, 72 are configured to provide signals to be radiated to the antenna systems 62, 64 and to receive and process signals that are received by, and provided to the front-end circuits 70, 72 from, the antenna systems 62, 64. The front-end circuits 70, 72 are configured to convert received IF signals from the IF circuit 74 to RF signals (amplifying with a power amplifier as appropriate), and provide the RF signals to the antenna systems 62, 64 for radiation. The front-end circuits 70, 72 are configured to convert RF signals received by the antenna systems 62, 64 to IF signals (e.g., using a low-noise amplifier and a mixer) and to send the IF signals to the IF circuit 74. The IF circuit 74 is configured to convert IF signals received from the front-end circuits 70, 72 to baseband signals and to provide the baseband signals to the processor 76. The IF circuit 74 is also configured to convert baseband signals provided by the processor 76 to IF signals, and to provide the IF signals to the front-end circuits 70, 72. The processor 76 is communicatively coupled to the IF circuit 74, which is communicatively coupled to the front-end circuits 70, 72, which are communicatively coupled to the antenna systems 62, 64, respectively.

The antenna systems 62, 64 may be formed as part of the PCB layer 56 in a variety of manners. In FIG. 3, dashed lines 71, 73 separating the antenna systems 62, 64 from the PCB 66 indicate functional separation of the antenna systems 62, 64 (and the components thereof) from other portions of the PCB layer 56. The antenna systems 62, 64 may be integral with the PCB 66, being formed as integral components of the PCB 66 or may be separate from, but attached to, the PCB 66. Alternatively, one or more components of the antenna system 62 and/or the antenna system 64 may be formed integrally with the PCB 66, and one or more other components may be formed separate from the PCB 66 and mounted to the PCB 66, or otherwise made part of the PCB layer 56. Alternatively, each of the antenna systems 62, 64 may be formed separately from the PCB 66 and mounted to the PCB 66 and coupled to the front-end circuits 70, 72, respectively. In some embodiments, one or both of the front-end circuits 70, 72 are implemented with the antenna system 62 or 64 in a module and coupled to the PCB 66. For example, the module may be mounted to the PCB 66 or may be spaced from the PCB 66 and coupled thereto, for example using flexible cable or a flexible circuit. The antenna systems 62, 64 may be configured similarly to each other or differently from each other. For example, one or more components of either of the antenna systems 62, 64, may be omitted. As an example, the antenna system 62 may include 4G and 5G radiators while the antenna system 64 may not include (may omit) a 5G radiator. In other examples, an entire one of the antenna systems 62, 64 may be omitted or may be configured for use with a non-cellular technology such as a WLAN technology.

A display 61 (see FIG. 2) of the display layer 54 may roughly cover the same area as the PCB 66 and serve as a system ground plane for the antenna systems 62, 64 (and possibly other components of the device 12). The display 61 is disposed below the antenna system 62 and above the antenna system 64 (with "above" and "below" being relative to the mobile device 12, i.e., with a top of the mobile device 12 being above other components regardless of an orientation of the device 12 relative to the Earth).

The antenna systems 62, 64 may be configured to transmit and receive millimeter-wave energy. The antenna systems 62, 64 may be configured to steer to different scan angels and/or to change size of beamwidth, e.g., between a PO beam and a narrower beam.

Figure 4:
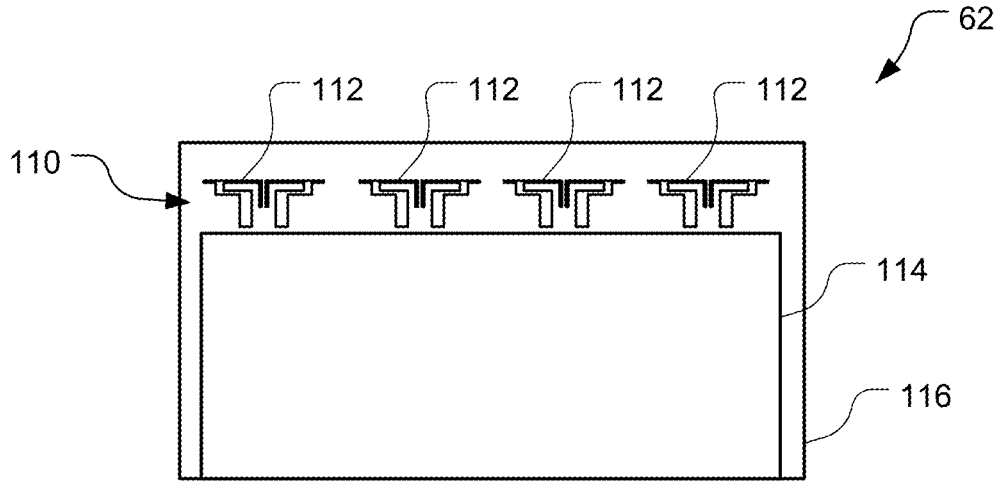
FIG. 4 is a top view of an example radiator array of one of the antenna systems shown in FIG. 3.

Referring also to FIG. 4, an example of the antenna system 62 is a millimeter-wave antenna system and includes an array 110 of folded dipoles 112, at least a portion of a ground plane 114, and a substrate 116. The folded dipoles 112 are configured to radiate and receive millimeter-wave signals and thus are folded dipole radiators, but are referred to herein as folded dipoles for simplicity. A center-to-center spacing of the folded dipoles 112 may be between 0.4λ and 0.6λ at the radiating frequencies of the folded dipoles 112 in the substrate 116. The ground plane 114 may be a ground of an antenna module, or may be a portion of the display 61 shown in FIG. 2, or may be part of the PCB 66, or may be another conductor. The folded dipoles 112 are end-fire dipoles configured and disposed to radiate energy with a main beam directed approximately perpendicular to a width of the folded dipoles 112. With the folded dipoles 112 disposed as shown, the main beams of the folded dipoles 112 will radiate out an end side of the mobile device 12, upwardly as oriented in FIG. 4. Also or alternatively, the folded dipoles 112 may be disposed (e.g., in an antenna module) with a different orientation relative to the mobile device 12 for radiation in other directions relative to the mobile device 12, e.g., out a left and/or right side of the mobile device 12, and/or perpendicularly out a front and/or back of the mobile device 12, and/or at a non-perpendicular angle out the front and/or back of the mobile device 12, etc. The folded dipoles are configured to radiate energy in both the 28 GHz band (26.5 GHz-29.5 GHz) and the 39 GHz band (37-40 GHz), and have been simulated to have return loss over both of these bands of better than −12 dB. Converse to at least some previous folded dipoles, radiating arms of the folded dipoles 112 are not electrically connected to each other. Here, folded conductors of the folded dipoles 112 do not connect to each other. The substrate 116 is a dielectric material, e.g., with a dielectric constant of about 3.3, and may comprise a portion of the PCB 66. Each of the folded dipoles 112 may be disposed in one or more layers of a multi-layer PCB. Also, the ground plane 114 may be disposed in one or more layers of a multi-layer PCB. While the array 110 is illustrated as including four folded dipoles 112, those of skill in the art will understand that a greater or fewer number of folded dipoles 112 may be implemented in an array. In some embodiments, a single dipole is implemented in the absence of an array. In other embodiments, an array including one or more folded dipoles 112 and one or more other types of antennas (e.g., shorted half wavelength patch antennas) is implemented.

Figure 5:
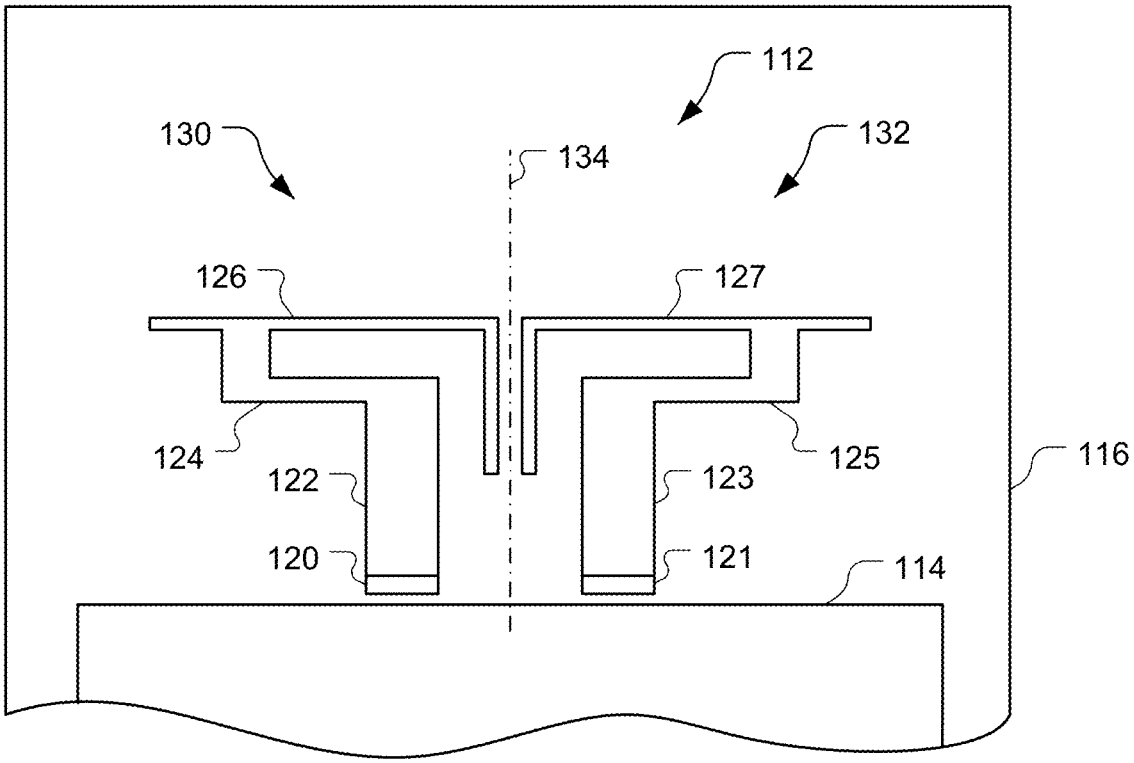
FIG. 5 is a top view of portion of a ground plane and one of the radiators shown in FIG. 4.
Figure 6:
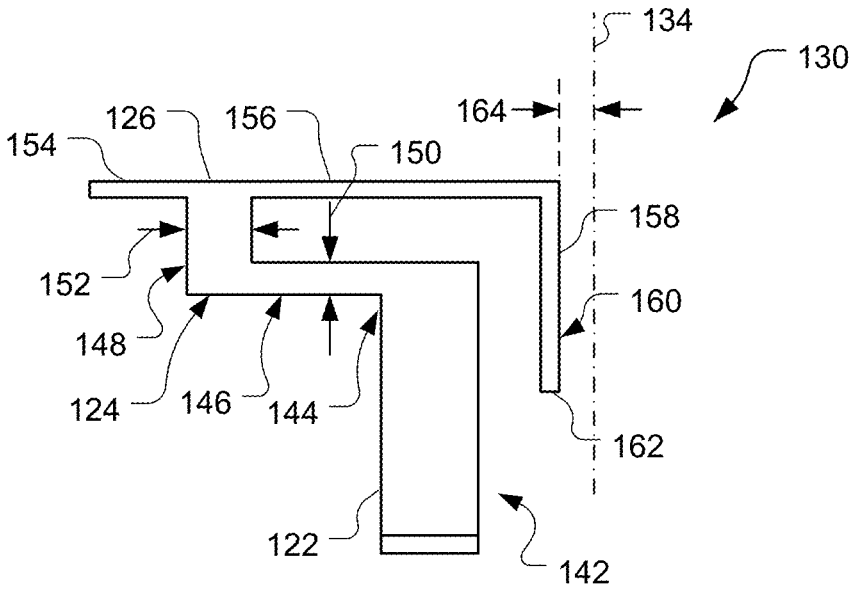
FIG. 6 is a top view of a half of the radiator shown in FIG. 5.

Referring also to FIGS. 5-6, the folded dipole 112 includes feed arms 122, 123, radiating arms 124, 125, and folded conductors 126, 127. The folded dipole 112 is a symmetric radiating structure with two symmetrical halves 130, 132 disposed on opposite sides of a centerline 134. Each of the halves 130, 132 is electrically conductive and the halves 130, 132 are separated from each other, being electrically isolated (i.e., not connected by a conductor and thus electrically separated). The folded dipole 112 is discontinuous, without a conductive connection between the feed arms 122, 123 via the radiating arms 124, 125. The folded dipole 112 is substantially T-shaped but with a central gap dividing and separating lateral halves of the folded dipole 112. The folded dipole 112 may be capable of radiating energy more effectively than at least some previous folded dipoles whose radiating arms are electrically connected. While called radiating arms, the radiating arms 124, 125 may not be the only portions of the folded dipole 112 that radiate energy. The halves 130, 132 are similarly configured and thus while the discussion below focuses on the half 130, the discussion applies equally well to the half 132. The folded dipole 112 may be less than half of a wavelength wide. Use of the folded conductors 126, 127 may allow the folded dipole 112 to be smaller than a folded dipole that has a folded conductor that connects radiating arms while providing acceptable performance characteristics.

The feed arms 122, 123 include feed connections 120, 121, respectively, and are configured to convey energy from the feed connections. The feed connections 120, 121 are each configured to be coupled, and are each coupled, to a transmission line configured to carry a signal from a signal source (e.g., the front-end circuit 70 or 72) for exciting the folded dipole 112. The feed connections 120, 121 are differentially fed with signals that are 180° out of phase relative to each other, with each of the feed connections 120, 121 receiving an active signal. The feed arms 122, 123 extend away from the ground plane 114 (upwardly as shown in FIG. 5) from proximal ends (e.g., a proximal end 142 of the feed arm 122) to distal ends (e.g., a distal end 144 of the feed arm 122). The feed arms 122, 123 comprise electrical conductors configured to conduct energy from the feed connections 120, 121 to the distal ends, e.g., to radiation connections connected to the radiating arms 124, 125. The feed arms 122, 123 are rectangular and extend parallel to each other and to the centerline 134, and are equally spaced from the centerline 134 (i.e., being displaced from the centerline 134 by the same distance).

The radiating arms 124, 125 are coupled to the feed arms 122, 123 and are electrical conductors configured to radiate energy at one or more desired frequencies. The radiating arms 124, 125 include first portions (e.g., a first portion 146 of the radiating arm 124) that extend away from (e.g., approximately perpendicular to) the centerline 134 and away from (e.g., approximately perpendicular to) distal portions of the feed arms 122, 123, extending outwardly as shown in FIG. 5. The radiating arms 124, 125 further include second portions (e.g., a second portion 148 of the radiating arm 124) that extend from the first portions of the radiating arms 124, 125 (upwardly as shown in FIG. 5). The second portions of the radiating arms 124, 125 extend parallel to the centerline 134. As shown, the first portions of the radiating arms 124, 125 and the second portions of the radiating arms 124, 125 have different widths. For example, a width 150 of the first portion 146 of the radiating arm 124 is smaller than a width 152 of the second portion 148 of the radiating arm 124.

The folded conductors 126, 127 are electrically conductive and are coupled to the radiating arms 124, 125, and each of the folded conductors 126, 127 includes an extension section, a transverse section, and a coupled arm section. An extension section 154 of the folded conductor 126 extends outwardly from the second portion 148 of the radiating arm 124 and thus extends further away from the centerline 134 than the radiating arm 124 (i.e., extends away from the centerline 134 more than the radiating arm 124). Thus, each of the extension sections of the folded conductors 126, 127 extend further away from the centerline 134 than the respective one of the radiating arms 124, 125 to which the folded conductor 126, 127 is coupled. Altering a configuration of the extension section 154 may tune one or more characteristics of the folded dipole 112. For example, using a longer extension section may lower a center frequency of the folded dipole 112. A configuration of the extension section 154 may be selected to provide one or more desired values of one or more corresponding characteristics. A transverse section 156 of the folded conductor 126 extends inwardly from the second portion 148 of the radiating arm 124 toward the centerline 134 and toward the transverse section of the other half of the folded dipole 112. The extension sections and the transverse sections of the folded conductors 126, 127 are disposed further from the ground plane 114 than the radiating arms 124, 125. A coupled arm section 158 of the folded conductor 126 extends toward the ground plane 114 (downwardly from the transverse section 156 as shown in FIGS. 5 and 6). The coupled arm section 158 may extend far enough that at least a distal portion 160 of the coupled arm section 158 is disposed between the feed arms 122, 123, with a distal end 162 being disposed between the feed arms 122, 123. The coupled arm sections extend approximately parallel to each other and approximately parallel to the centerline 134 and are disposed closer to the centerline 134 than the feed arms 122, 123.

It has been found that configuring the folded conductors 126, 127 with the coupled arms close to each other but not electrically connected to each other increases radiation (e.g., reduces insertion loss and/or increases transmitted power) of the folded dipole 112 compared to a folded dipole with folded conductors that are electrically connected. The coupled arm section 158 is displaced from the centerline 134 by a non-zero distance 164. The distance 164 from the coupled arm section 158 to the centerline 134 may be selected such that the folded conductors 126, 127 capacitively couple energy to each other sufficiently to provide one or more desired radiation characteristics over desired frequencies, e.g., improved radiation (e.g., lower insertion loss) compared to a dipole where the folded conductors connect to each other. For example, the distance 164 may be 400 μm (micro-meters) or less for use of the folded dipole 112 over frequencies 26.5 GHz-29.5 GHz and 37 GHz-40 GHz. As further examples, the distance 164 may be 120 μm or less for use with these frequencies, or may be 60 μm or less for use with these frequencies. As further examples, the distance 164 may be less than 0.1 wavelengths, or less than 0.05 wavelengths, or less than 0.02 wavelengths, or less than 0.01 wavelengths of a highest desired radiated frequency. Computer simulations of the folded dipole 112 have shown the folded dipole 112 to have a return loss better than −10 dB from 26.5 GHz to 29.5 GHz and from 37 GHz to 40 GHz. The simulated return loss over these bands for the folded dipole 112 was at least 2 dB better than for a folded dipole where a folded conductor connected the radiating arms. Dimensions of the folded dipole 112, and in particular of the coupled arms 126, 127 may be varied to alter radiation characteristics (e.g., return loss vs. frequency) of the folded dipole 112.

Further, the coupled arms of the folded conductors 126, 127 are disposed adjacent to each other. While the coupled arms of the folded conductors 126, 127 are separated, and thus not adjacent in the sense of abutting, the coupled arms are adjacent in that there are no other portions of the folded dipole 112 between the coupled arms of the folded conductors 126, 127. Thus, a region between the coupled arm 158 and the centerline 134 is free of (devoid of, without) any other conductive portion of the folded dipole 112. The same applies to the coupled arm of the folded conductor 127.

As shown, a width of the folded conductors 126, 127 may be the same for the different sections and may be smaller than widths of the feed arms 122, 123 and the radiating arms 124, 125. The different sections of the folded conductors 126, 127, however, may have different widths. Also or alternatively, while the width of the folded conductors 126, 127 as shown is smaller than widths of other portions of the folded dipole 112, one or more widths of the folded conductors 126, 127 may be larger than a width of one or more other portions of the folded dipole 112.

The folded dipole 112 is shown as a planar structure with the feed arms 122, 123, the radiating arms 124, 125, and the folded conductors 126, 127 comprising electrical conductors, here strips of electrically-conductive material of different widths disposed in a common layer (e.g., a top layer) of a PCB or at least partially disposed in a single plane. Different configurations, however, may be used. For example, different portions of a folded dipole according to the teachings herein may be disposed in different layers of a multi-layer structure. Each of the halves 130, 132 of the folded dipole 112 may be an integral, monolithic electrical conductor as shown or may be composed of separate pieces that are electrically connected to each other.

Configurations other than the examples discussed above may be used. For example, folded dipoles may not include extension sections (like the extension section 154) that extend outside of the radiating arms. As another example, different widths and/or lengths of portions of the folded dipole 112 than those shown and/or discussed may be used.

Certain embodiments may reduce undesired capacitive coupling between the antenna (e.g., the folded dipole 112) and ground (e.g., ground plane 114). In some embodiments, the length of conductor in the antenna may be greater than other dipoles occupying the same space on the PCB, and the amount of conductor spaced from the ground is greater. Further, implementing an antenna in which the halves 130, 132 are electrically disconnected may create a more uniform current/field distribution throughout the antenna, which may decrease the likelihood of coupling between the antenna and ground and/or increase bandwidth of the antenna.

Simulated Folded Dipole

Figure 7:
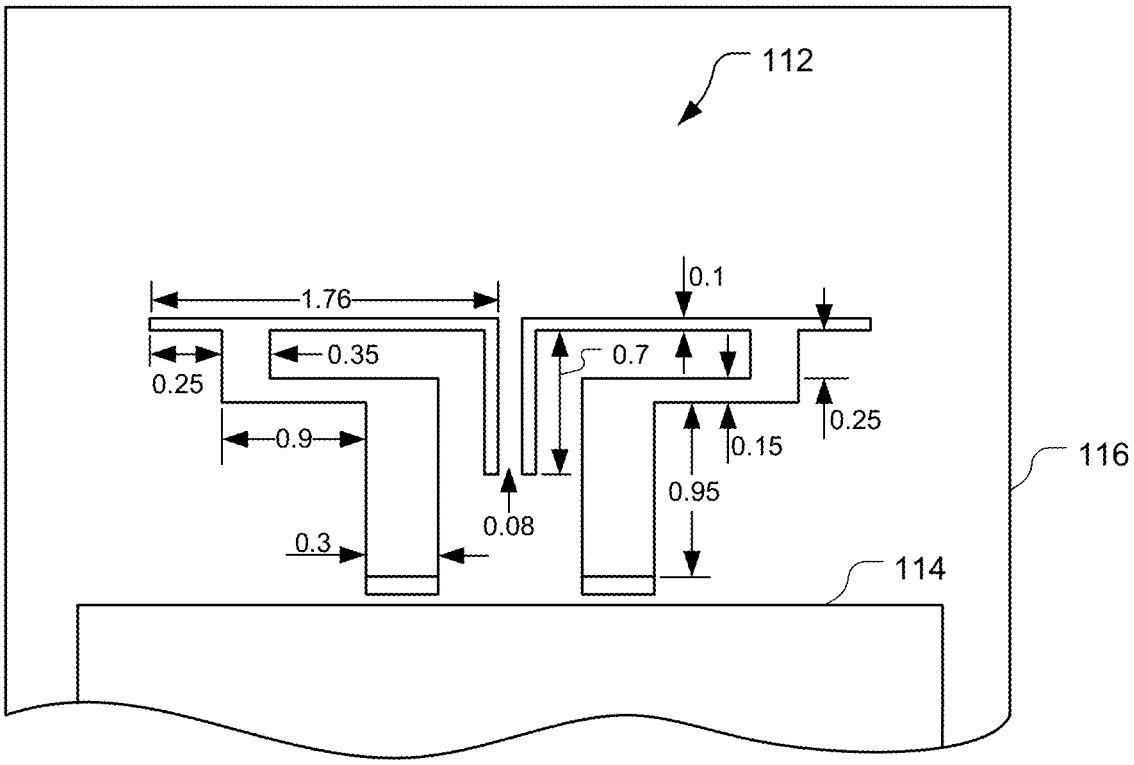
FIG. 7 is a top view of an example radiator showing dimensions used for a simulation.
Figure 8:
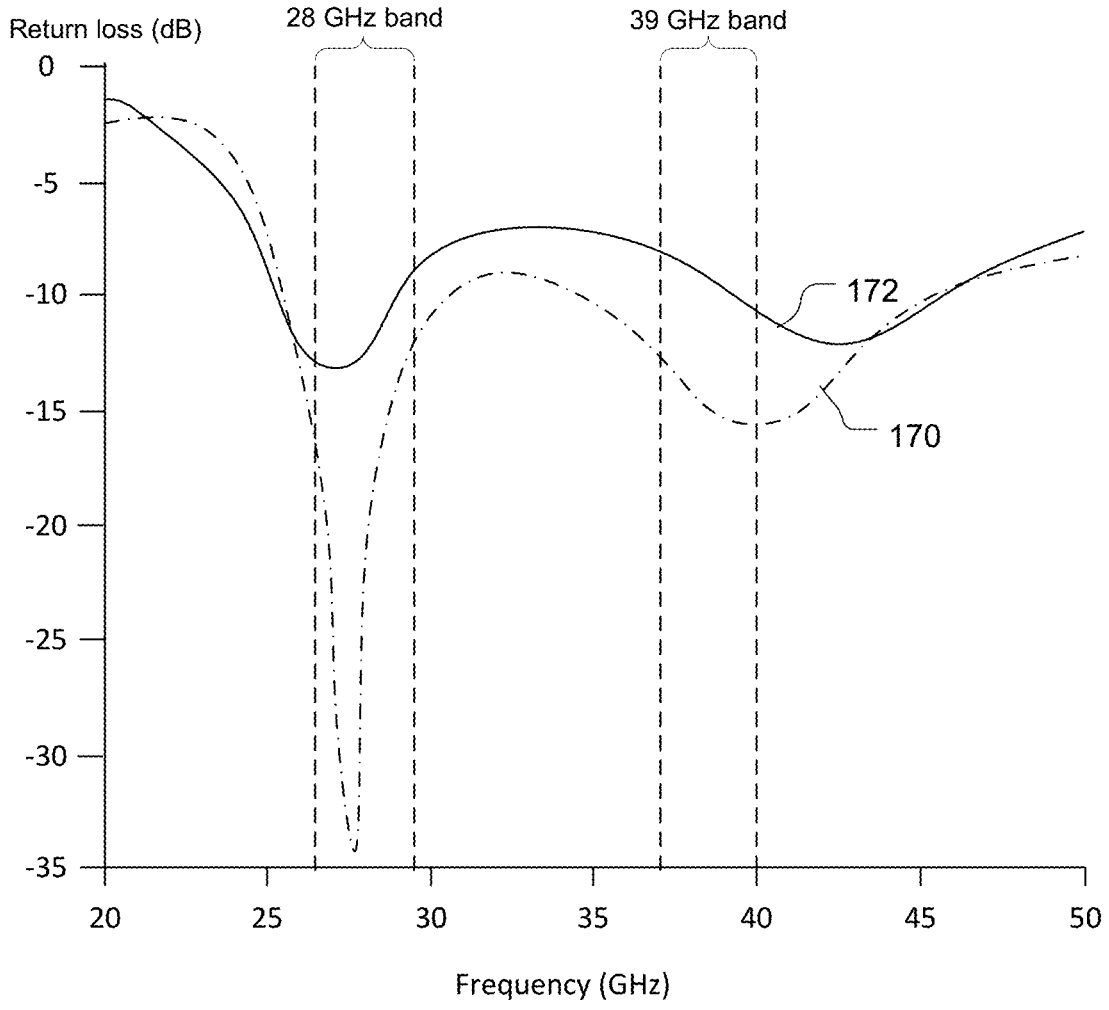
FIG. 8 is a graph of simulated return loss plots for the radiator shown in FIG. 7 and a folded dipole with connected radiating arms.

Referring also to FIGS. 7-8, a simulation was performed for an example of the folded dipole 112 shown in FIGS. 5-6. In the simulation, the substrate 116 had a dielectric constant of 3.3, and the folded dipole 112 had dimensions shown in FIG. 7 as follows. Lengths of the feed arms 122, 123 from the feed connections 120, 121 to bottoms of the radiating arms 124, 125 were 0.95 mm. Widths of the feed arms 122, 123 were 0.3 mm. Lengths of the radiating arms 124, 125 from the feed arms 122, 123 to ends of the radiating arms 124, 125 were 0.9 mm. Widths of the radiating arms 124, 125 were 0.15 mm. Links from the radiating arms 124, 125 to the coupled arms 126, 127 were 0.35 mm wide and extended 0.25 mm in length. The coupled arms 126, 127 extended horizontally 1.76 mm, including extending 0.25 mm outside of the links to the radiating arms 124, 125, and had widths of 0.1 mm. The coupled arms 126, 127 extend vertically 0.7 mm and a gap between distal ends of the coupled arms 126, 127 was 0.08 mm. With this configuration, a simulated return loss was achieved as shown in FIG. 8. A return loss 170 of this example folded dipole with coupled arms extending between the feed arms is better than −12 dB over both the 28 GHz band and the 39 GHz band. Further, the return loss 170 is better than a simulated return loss 172 of a folded dipole of similar dimensions but with the radiating arms being linearly connected (i.e., without coupled arms extending toward the feed arms/ground plane). These dimensions are examples only, and not limiting of the disclosure. Other dimensions for one or more, or even all of the features, may be used, with the different dimensions affecting operation of the dipole, e.g., creating tradeoffs between operation at different frequencies.

OTHER CONSIDERATIONS

As used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. Further, some items have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of operations may be undertaken before, during, or after the above elements are considered. Accordingly, the above description does not bound the scope of the claims.

Further, more than one invention may be disclosed.

The invention claimed is:

1. A millimeter-wave antenna system comprising:

a ground plane; and a folded dipole radiator comprising:

a plurality of feeds each extending away from the ground plane from a proximal feed end to a distal end;

a plurality of radiating arms each coupled to and extending away from the distal feed end of a respective one of the plurality of feeds; and a plurality of folded conductors each coupled to a respective one of the plurality of radiating arms and each having a distal portion extending toward the ground plane to a distal conductor end;

wherein each of the plurality of feeds and each of the plurality of radiating arms comprises an electrical conductor;

wherein the folded dipole radiator is discontinuous, without a conductive connection between the plurality of feeds via the plurality of radiating arms; and wherein the folded dipole radiator is disposed in a multi-layer structure and configured to have a return loss better than −10 dB from 26.5 GHz to 29.5 GHz and from 37 GHz to 40 GHz.

2. The antenna system of claim 1, wherein the distal portions of the plurality of folded conductors are disposed without another conductive portion of the folded dipole radiator between the distal portions of the plurality of folded conductors.

3. The antenna system of claim 1, wherein the distal portions of the plurality of folded conductors are separated from each other by less than 0.1 wavelengths at a frequency at which the folded dipole radiator has an insertion loss of better than −10 dB.

4. The antenna system of claim 1, wherein the distal conductor end of each of the plurality of folded conductors is disposed between the plurality of feeds.

5. The antenna system of claim 1, wherein the plurality of feeds are parallel to each other and to a centerline of the folded dipole radiator, and wherein each of the plurality of folded conductors extends further away from the centerline than the respective one of the plurality of radiating arms to which the folded conductor is coupled.

6. The antenna system of claim 1, wherein at least a portion of each of the plurality of radiating arms extends away from the distal feed end of the respective one of the plurality of feeds in an opposite direction from another of the plurality of radiating arms.

7. The antenna system of claim 6, wherein each of the plurality of radiating arms comprises a first portion extending away from the distal feed end of the respective one of the plurality of feeds in the opposite direction, and wherein each of the plurality of radiating arms comprises a second portion extending away from the first portion in a direction approximately parallel to a direction of the plurality of feeds.

8. A millimeter-wave antenna system comprising:

a ground plane; and a folded dipole radiator comprising:

a plurality of feeds each extending away from the ground plane from a proximal end to a distal feed end;

a plurality of radiating arms each coupled to and extending away from the distal feed end of a respective one of the plurality of feeds; and a plurality of folded conductors each coupled to a respective one of the plurality of radiating arms and each having a distal conductor end, wherein a distance between each distal conductor end and the ground plane is less than a distance between the distal feed end of the respective one of the plurality of feeds and the ground plane;

wherein each of the plurality of feeds and each of the plurality of radiating arms comprises an electrical conductor.

9. The antenna system of claim 8, wherein the distal conductor ends are disposed between the plurality of feeds.

10. The antenna system of claim 8, wherein the folded dipole radiator is discontinuous, without a conductive connection between the plurality of feeds via the plurality of radiating arms.

11. The antenna system of claim 8, wherein distal portions of the plurality of folded conductors are parallel to each other and are disposed without another conductive portion of the folded dipole radiator between the distal portions of the plurality of folded conductors.

12. The antenna system of claim 11, wherein the distal portions of the plurality of folded conductors are separated from each other by less than 0.1 wavelengths at a frequency at which the folded dipole radiator has an insertion loss of better than −10 dB.

13. The antenna system of claim 8, wherein the plurality of feeds are parallel to each other and to a centerline of the folded dipole radiator, and wherein each of the plurality of folded conductors extends further away from the centerline than the respective one of the plurality of radiating arms to which the folded conductor is coupled.

14. An antenna comprising:

a symmetric radiating structure comprising a first half and a second half each electrically conductive and that are electrically separated from each other, each of the first half and the second half being configured similarly, the first half comprising:

first feed means for connecting to a signal source and for conducting energy from a feed connection to a radiation connection, the first feed means extending in a first direction from the feed connection;

radiating means, coupled to the first feed means, for radiating the energy, the radiating means extending from the radiation connection in a second direction away from the second half; and first coupling means, coupled to the radiating means, for coupling energy to second coupling means of the second half, wherein a first distal portion of the first coupling means and a second distal portion of second coupling means of the second half extend parallel to each other and are separated by less than 400 micro-meters.

15. The antenna of claim 14, wherein the signal source is configured to provide respective differential signals to the first feed means and to second feed means of the second half.

16. The antenna of claim 14, wherein the first coupling means are for capacitively coupling the energy to the second coupling means.

17. An antenna comprising a symmetric radiating structure comprising a first half and a second half each electrically conductive and that are electrically separated from each other, each of the first half and the second half being configured similarly, the first half comprising:

first feed means for connecting to a signal source and for conducting energy from a feed connection to a radiation connection, the first feed means extending in a first direction from the feed connection;

radiating means, coupled to the first feed means, for radiating the energy, the radiating means extending from the radiation connection in a second direction away from the second half; and first coupling means, coupled to the radiating means, for coupling energy to second coupling means of the second half, wherein a portion of the first coupling means is disposed between the first feed means and second feed means of the second half.

18. The antenna of claim 14, wherein the first coupling means and the second coupling means are physically separate, without a direct conductive connection between the first coupling means and the second coupling means.

19. The antenna of claim 14, wherein a distal portion of the first coupling means is disposed closer to a centerline of the antenna than the first feed means.

20. The antenna of claim 19, wherein the first coupling means extends at least partially between the first feed means and second feed means of the second half.

21. The antenna of claim 20, wherein a distal end of the first coupling means is disposed between the first feed means and the second feed means.

22. The antenna of claim 17, wherein a first distal portion of the first coupling means and a second distal portion of second coupling means of the second half extend parallel to each other and are separated by less than 400 micro-meters.

23. The antenna of claim 14, wherein the first feed means, the radiating means, and the first coupling means all comprise electrically-conductive strips at least partially disposed in a plane.

24. The antenna of claim 14, wherein the first coupling means extend further than the radiating means from a centerline of the antenna separating the first half and the second half.

25. The antenna of claim 14, wherein the second direction is transverse to the first direction.

26. The antenna of claim 25, wherein the first direction is parallel to a centerline of the antenna that divides the first half and the second half.

* * * * *